US012479479B2

(12) United States Patent
Hans Wolfgang Coester et al.

(10) Patent No.: US 12,479,479 B2
(45) Date of Patent: Nov. 25, 2025

(54) EMERGENCY FRONT DOOR FOR PNEUMATICALLY-PROPELLED VEHICLES ON AN ELEVATED TRACK

(71) Applicant: Aerom Sistemas De Transporte SA, São Leopoldo (BR)

(72) Inventors: Oskar Hans Wolfgang Coester, Porto Alegre (BR); Marcus Coester, Porto Alegre (BR)

(73) Assignee: Aerom Sistemas De Transporte SA, São Leopoldo (BR)

( * ) Notice: Subject to any disclaimer, the term of this patent is extended or adjusted under 35 U.S.C. 154(b) by 752 days.

(21) Appl. No.: 17/788,592

(22) PCT Filed: Dec. 8, 2020

(86) PCT No.: PCT/BR2020/050522
§ 371 (c)(1),
(2) Date: Jun. 23, 2022

(87) PCT Pub. No.: WO2021/127759
PCT Pub. Date: Jul. 1, 2021

(65) Prior Publication Data

US 2023/0031513 A1 Feb. 2, 2023

(30) Foreign Application Priority Data

Dec. 27, 2019 (BR) ..... 102019028068-9

(51) Int. Cl.
*B61D 19/02* (2006.01)
*B61D 23/02* (2006.01)

(52) U.S. Cl.
CPC ..... *B61D 19/023* (2013.01); *B61D 23/02* (2013.01)

(58) Field of Classification Search
CPC ..... B61D 19/00; B61D 19/02; B61D 19/023; B61D 23/00; B61D 23/02
See application file for complete search history.

(56) References Cited

U.S. PATENT DOCUMENTS 4,216,725 A 8/1980 Hallam
4,615,275 A 10/1986 Ishizuka

FOREIGN PATENT DOCUMENTS

CN 204871031 U 12/2015
DE 2640317 A1 3/1977
(Continued)

OTHER PUBLICATIONS

International Search Report in international application No. PCT/BR2020/050522 mailed Feb. 9, 2021, 3 pages.
(Continued)

*Primary Examiner* — Robert J McCarry, Jr.
(74) *Attorney, Agent, or Firm* — Berg Hill Greenleaf Ruscitti LLP.

(57) ABSTRACT

The front door (1) articulates by means of upper hinges (2), assisted by dampers (3) connected to the internal structure (4) of the front door (1). It includes a lower portion (5) articulated by the lower hinge (6) to the structure of the vehicle (VP). The lower portion of the door (5) projects outwards when the front door (1) is opened through the action of cables (15) and pulleys (16). A retractable staircase (7) extends; when retracted, it folds under the floor of the vehicle (8). The front door (1) is activated internally by the passengers using a lever (9) that turns a rod (10), moving shafts (11) that release the locking mechanism. An electromagnetic safety key, making it possible to open the front door (1) if the vehicle breaks down.

4 Claims, 9 Drawing Sheets

(56) References Cited

FOREIGN PATENT DOCUMENTS

Figure 1:
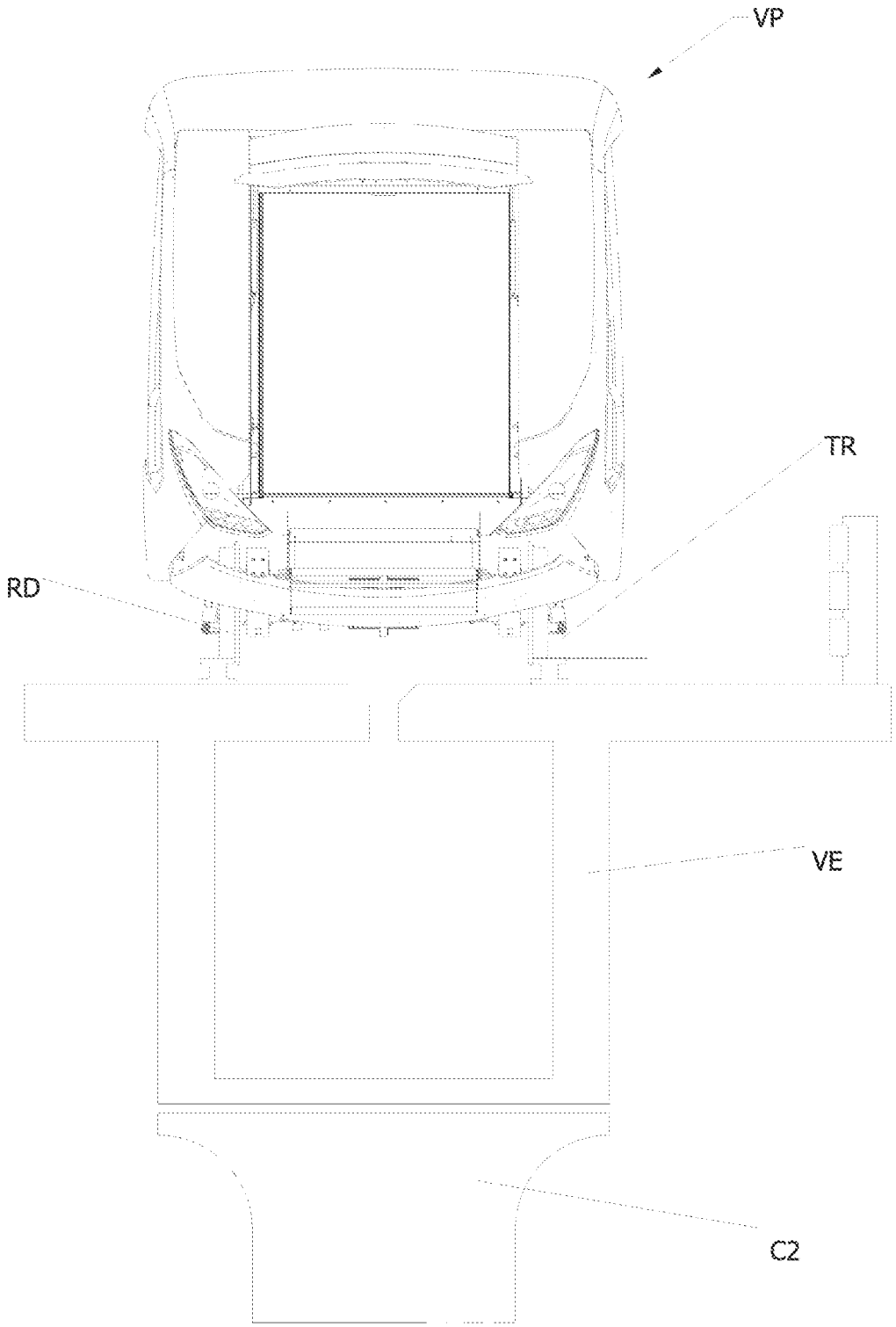

| | | | | |
|---|---|---|---|---|
| DE | 10020426 | C1 | 10/2001 | |
| EP | 0776808 | B1 | 6/1997 | |
| EP | 3461713 | A1 * | 4/2019 | ..... B61C 17/04 |
| GB | 2409195 | A | 6/2005 | |
| WO | 02081282 | A1 | 10/2002 | |
| WO | 2011013847 | A2 | 2/2011 | |

OTHER PUBLICATIONS

Written Opinion/International Preliminary Examination Report in international application No. PCT/BR2020/050522 mailed Feb. 9, 2021, 6 pages.

* cited by examiner

EMERGENCY FRONT DOOR FOR PNEUMATICALLY-PROPELLED VEHICLES ON AN ELEVATED TRACK

CROSS-REFERENCE TO RELATED APPLICATION

This application is a national stage application under 35 U.S.C. 371 of PCT Application No. PCT/BR2020/050522 having an international filing date of Dec. 8, 2020, which designated the United States, which PCT application claimed the benefit of Brazil application Serial No. 102019028068-9, filed Dec. 27, 2019, both of which are incorporated by reference in their entirety.

TECHNOLOGICAL SECTOR OF THE INVENTION

This invention belongs to the safety engineering sector, and refers more specifically to a front door emergency exit for pneumatic propulsion vehicles on an elevated guideway. Consequently, the invention deals with improvements to the emergency exit of this type of vehicle that result in constructive simplicity, the possibility of adaptation for use in a large variety of bodywork designs, a large translucent front area, and easy access to the emergency escape route.

The front door is actuated by a lever, through which it is possible to unlock the door if the vehicle is not moving. Moreover, the front door also comprises a tilting staircase, which extends automatically when the door opens.

STATE OF THE ART

Driverless vehicles that travel on an elevated guideway must have the conditions needed for fast, safe passenger evacuation in adverse emergency situations, with no need for help from outside agents.

The most common technique involves the use of vehicle service doors that include an emergency exit function to walkways generally made from metal structures and installed on both sides of the elevated guideway along its entire length.

This configuration has economic impacts due to the weight of the structures, difficulties entering the emergency route because of differences in the levels of the vehicle floor and the walkway, in addition to visual obstruction resulting from the larger shadow projected by the assembly on the surface.

There are also applications, although in fewer, that involve the use of the two opposite ends of the vehicle as means for emergency evacuation, eliminating the side walkways and using the upper slab of the elevated guideway itself for movement. These solutions are specific to each type of vehicle technology, using complex actuation systems that make it difficult for passengers to operate them.

In U.S. Pat. No. 8,083,282, a document entitled DOOR OF A VEHICLE describes an emergency exit door at the front of the vehicle with a complex opening system that projects the door upwards on two hinged pantograph-type articulated arms that hold the door in the same vertical position. One drawback of this door is that it is narrow, allowing only one passenger to exit at a time, which is not satisfactory in case of emergency. Another drawback is that the door does not have an inside lever that is easily usable and accessible for quick opening by the passengers themselves. Another inconvenience of this door is that it is not connected to a staircase or a similar device that allows passengers to descend, as the vehicle floor is higher than the track floor. Yet another inconvenience is that the door has a small translucent area, hampering visibility for passengers.

EP Patent 2 748 045 has a entitled EMERGENCY EXIT UNIT FOR A RAIL VEHICLE that describes an emergency exit door at the front of the vehicle, actuated from the inside and releasing an emergency exit ramp. However, this ramp must be lowered manually by a skilled person, which is not the case for an ordinary passenger. Furthermore, this document presents the same constraints as reported in the analysis of the previous document.

NOVELTY AND PURPOSE OF THE INVENTION

The invention solves problems at the state of the art through an emergency front door with a lower portion that tilts downwards and an upper portion that tilts upwards. The lower portion of the door is below the floor and covers a retractable door compartment. The base of the upper portion of the door is level/tiered with the floor. As the door opens in two parts, its operation is simple and agile, being held up by common mechanisms, as only a front portion of the door is raised. The invention also comprises an emergency exit staircase that is kept retracted, extending automatically when the front door opens, with no specific effort required for its opening and needs no manual actuation by a passenger. As it retracts into an underfloor compartment, the retracted staircase does not interfere in the internal space of the vehicle. For greater passenger safety, the invention comprises an electromagnetic key, which prevents the door from opening when the vehicle is moving.

Hence, the purpose of this invention is a front door for an emergency exit on pneumatic vehicles moving along an elevated guideway defined by guide beams, with the door covering a large frontal area of the vehicle, comprising translucent surface, installed in a frame affixed to the bodywork and fitted with an automatic opening gas spring that keeps the door open.

For easier opening from the inside and passenger outflows, the front door opens upwards, held in a horizontal position by dampers that connect the door to the frame. To open the front door, pressing a lever on the inside releases an internal lock.

The emergency front door of the invention also has a safety device, to prevent the release of the internal lock when the vehicle is moving. This device is known as an electromagnetic switch, which acts on a pin in the door latch and prevents unintentional actuation of the inner lever.

Optionally, the internal front door latches may be released by an outside lever. In this case the electromagnetic key has no effect, as the outside lever may be accessed only when the vehicle is already stopped, for example during vehicle maintenance.

The technical characteristic presented by this invention is compliant with the requirements for applications demanding very high equipment availability, robustness and safety.

An emergency exit front door for pneumatic vehicles addressed by this invention results in the following advantages over the state of the art:

- Modularity of the solution, applicable to a wide variety of vehicle front geometries with minimal adaptations;
- Easy internal and external actuation;
- Access to the elevated guideway through a staircase that is not visible to the user, but which is automatically actuated when the front door opens, with no need for human intervention;

Does not reduce the translucent area at the front of the vehicles.

Can be operated by passengers themselves, with no need for a trained operator.

Automatically projects the staircase outwards as the door opens;

The floor is completely flat and obstacle-free, with no differences in levels that hinder exiting passengers.

LIST OF FIGURES

In this Specification, the components shown in the Figures are not necessarily drawn to scale, with emphasis on examples illustrating aspects of the invention, which may be represented in simplified form.

Figure 2:
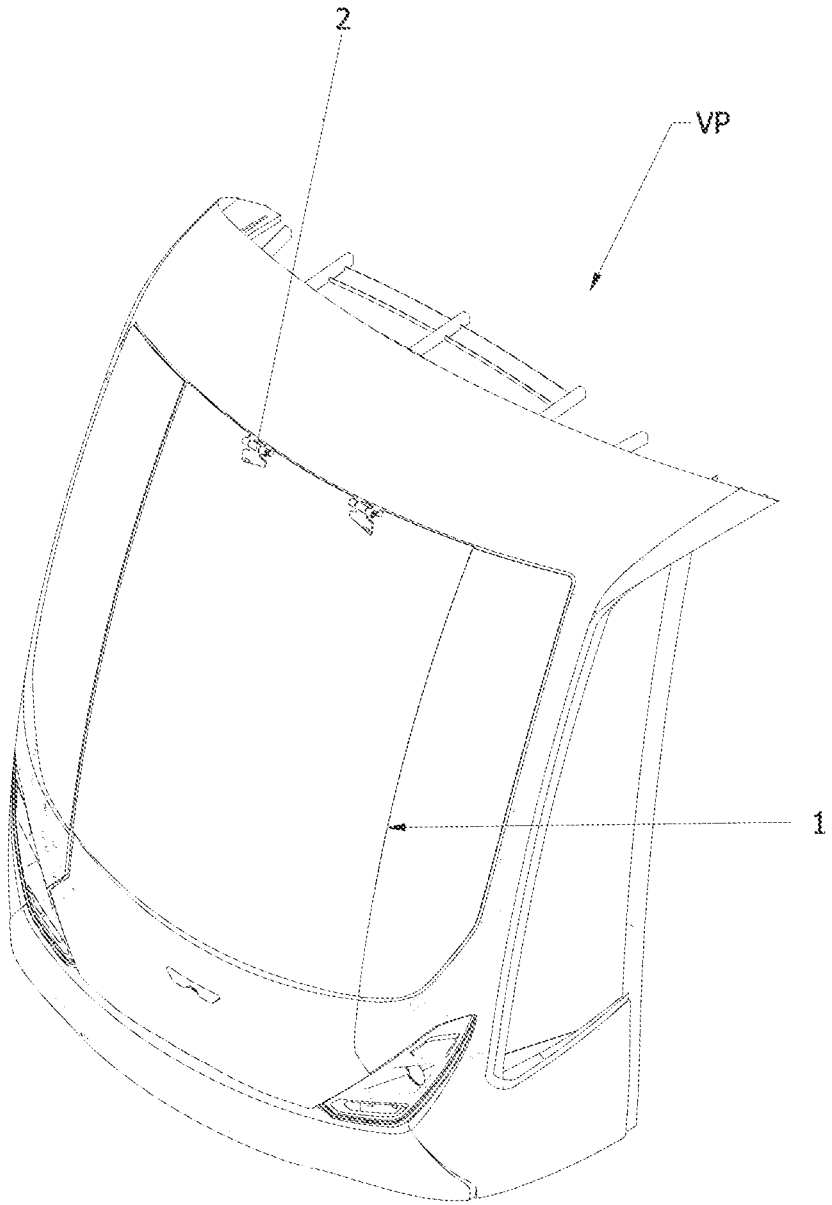
Figure 3:
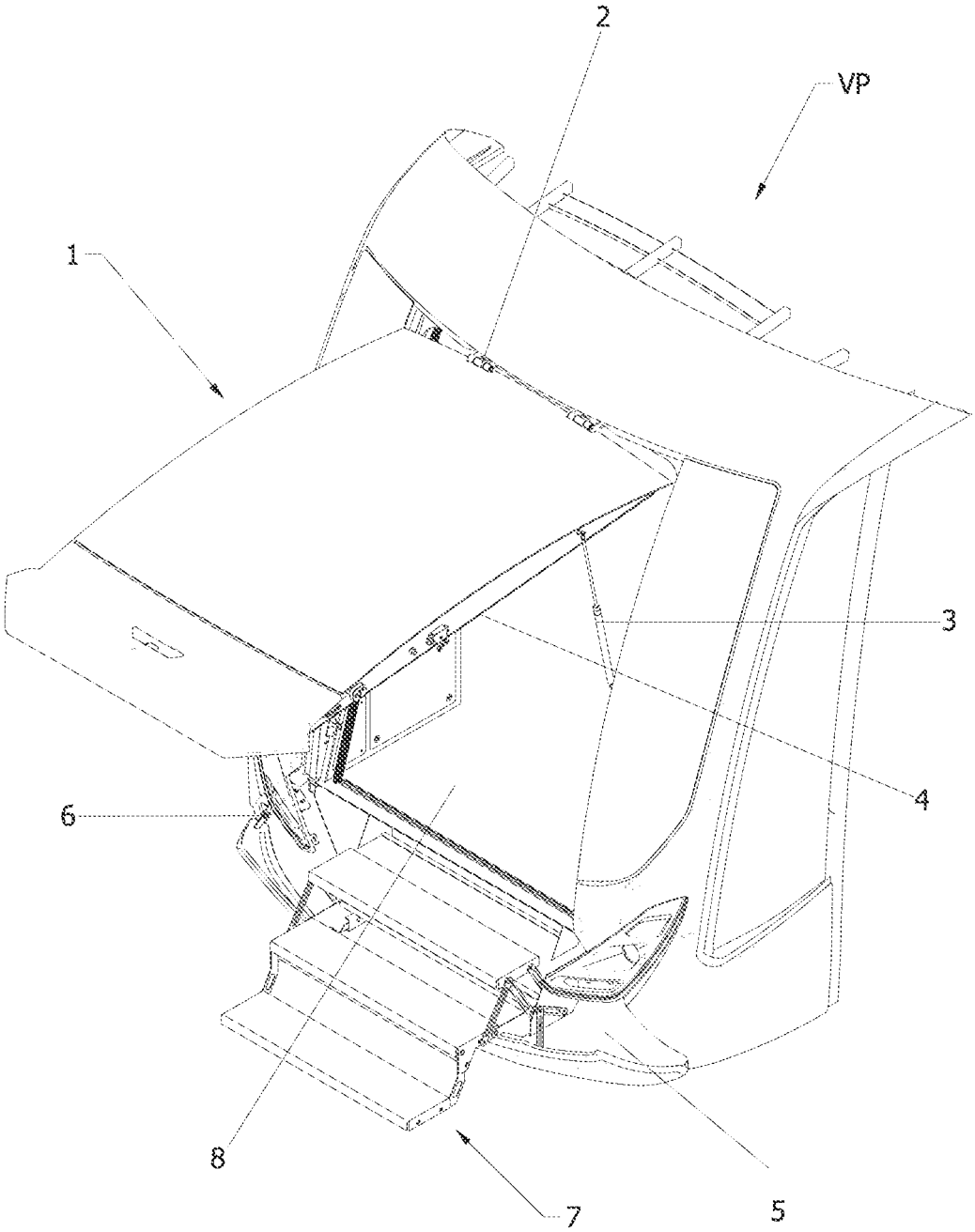
Figure 4:
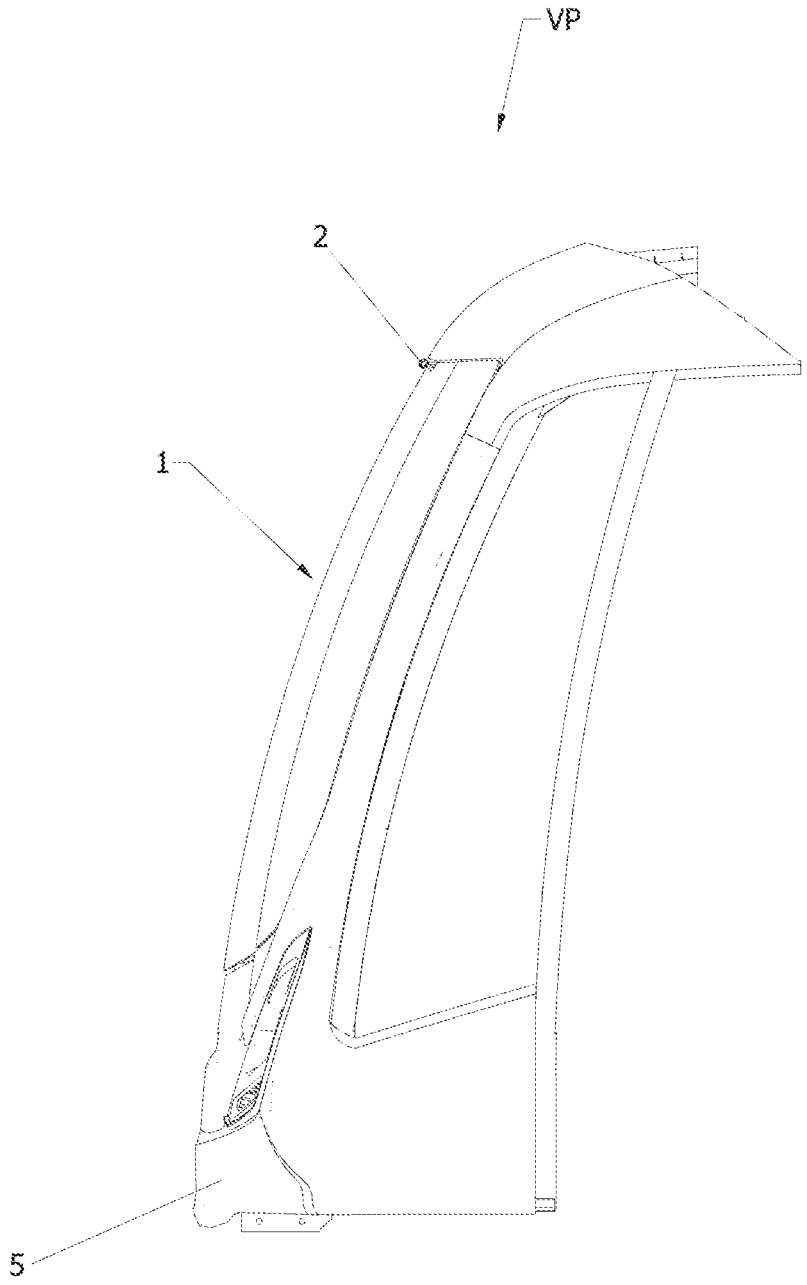

In order for this invention to be fully understood and put into practice by any person skilled in this technological sector, it is described clearly and sufficiently hearing, based on the Figures appended hereto and listed below:

FIG. 1—Front view of the vehicle on the elevated track;

FIG. 2—Perspective view of the vehicle with the front door shut;

FIG. 3—Perspective view of the vehicle with the front door open;

FIG. 4—Side view of the front of the vehicle with the front door shut

Figure 5:
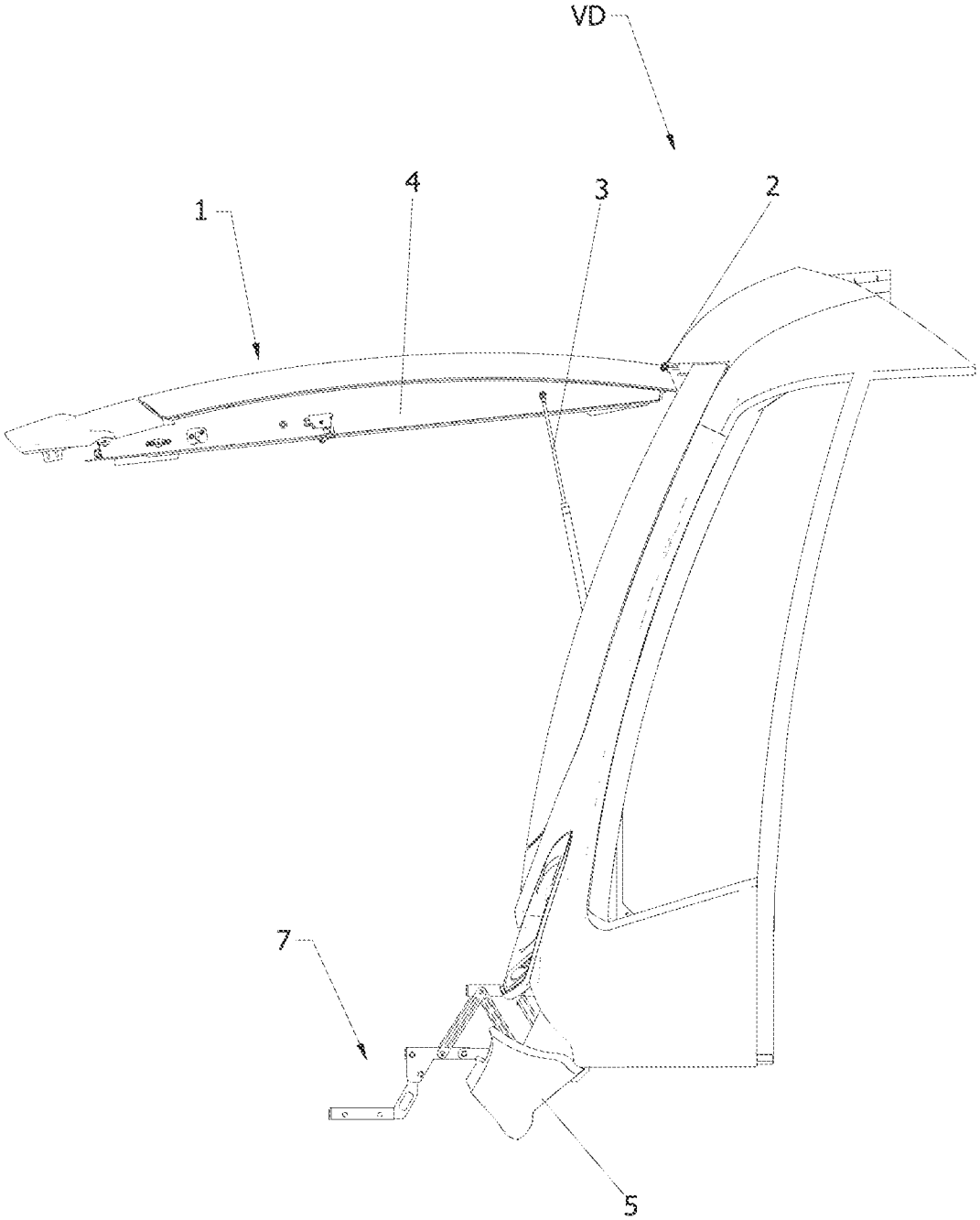
Figure 6:
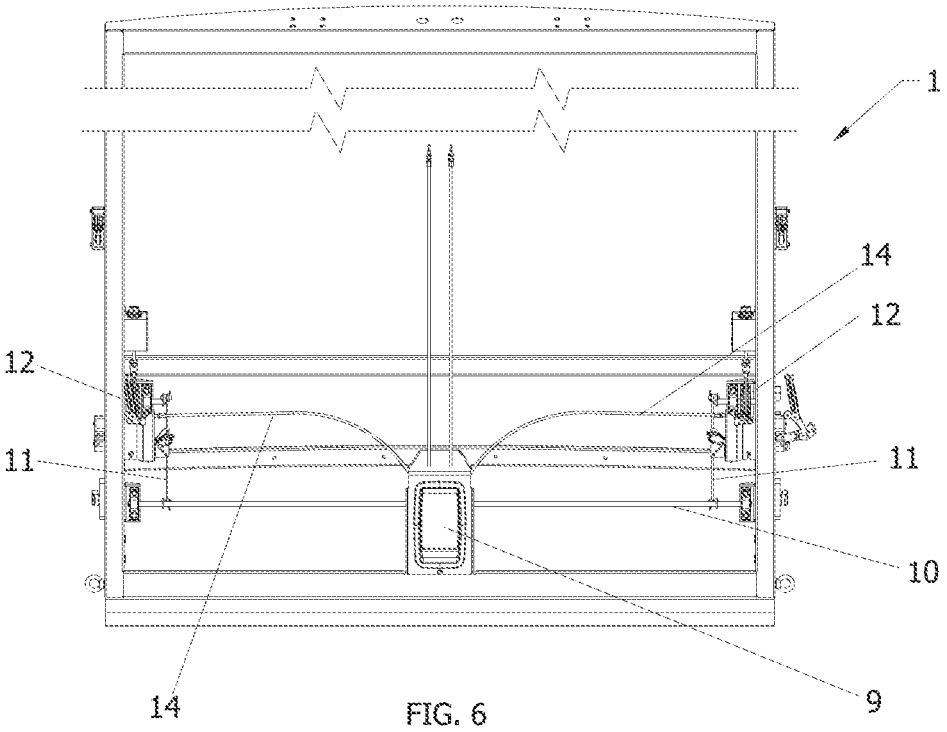
Figure 7:
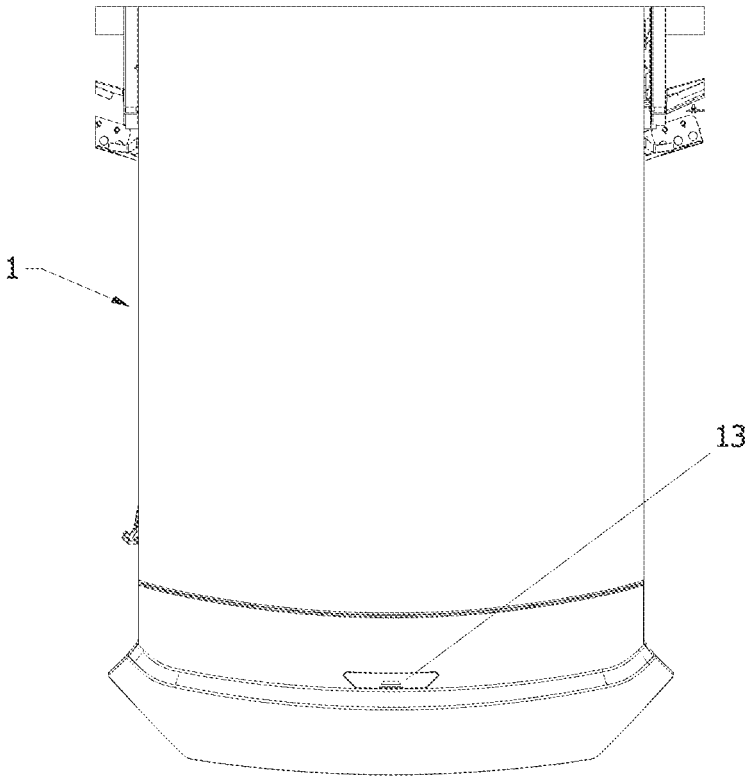
Figure 8:
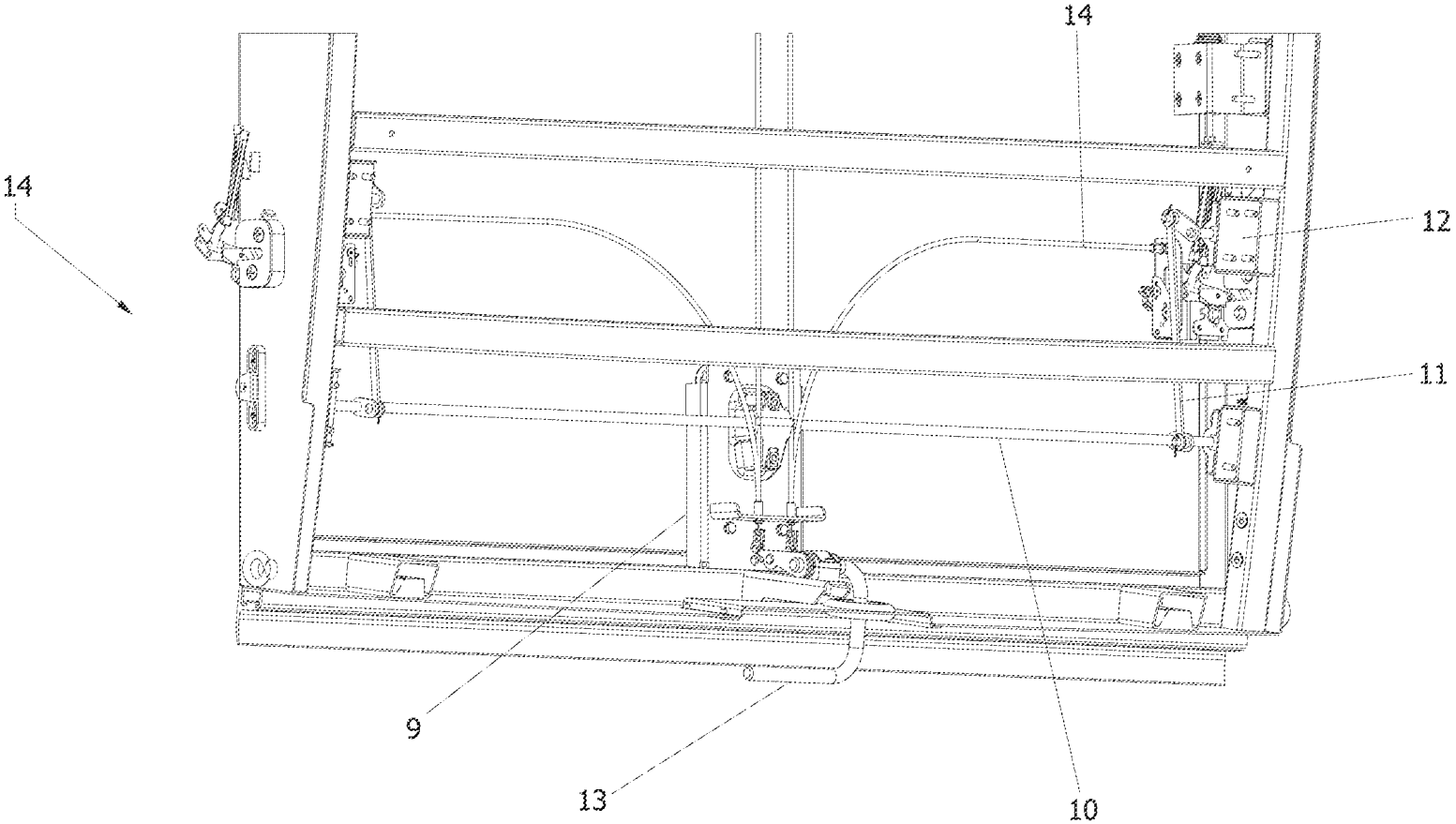
Figure 9:
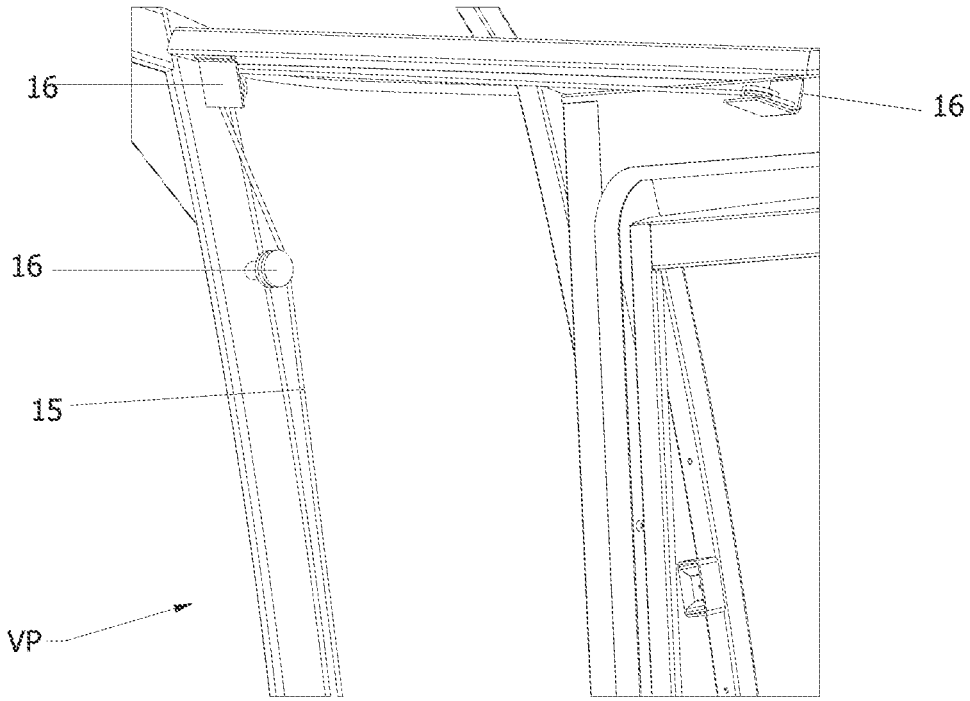
Figure 10:
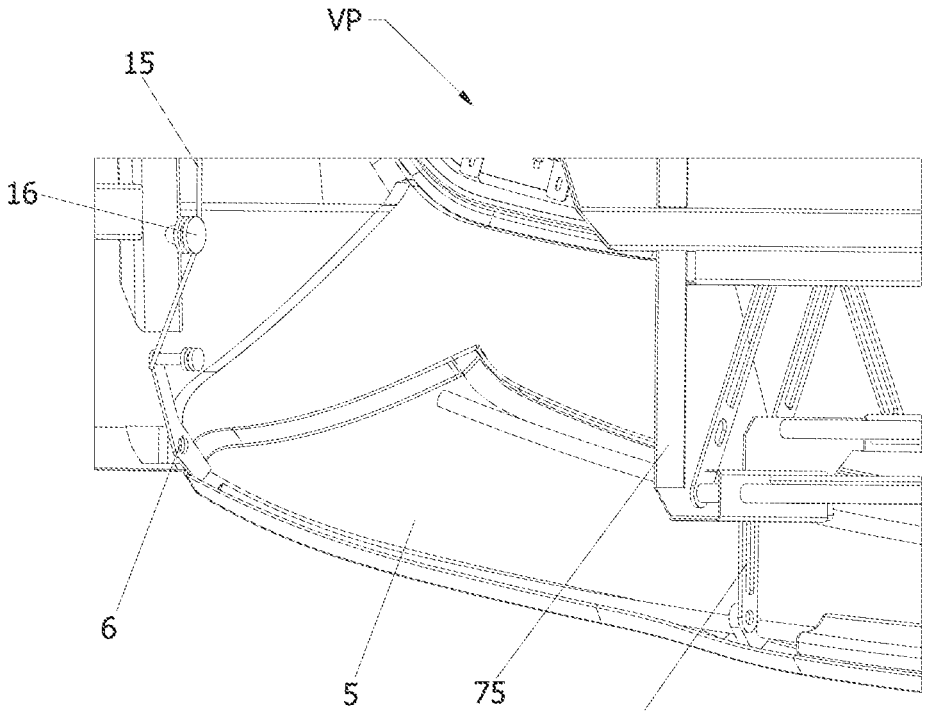
Figure 11:
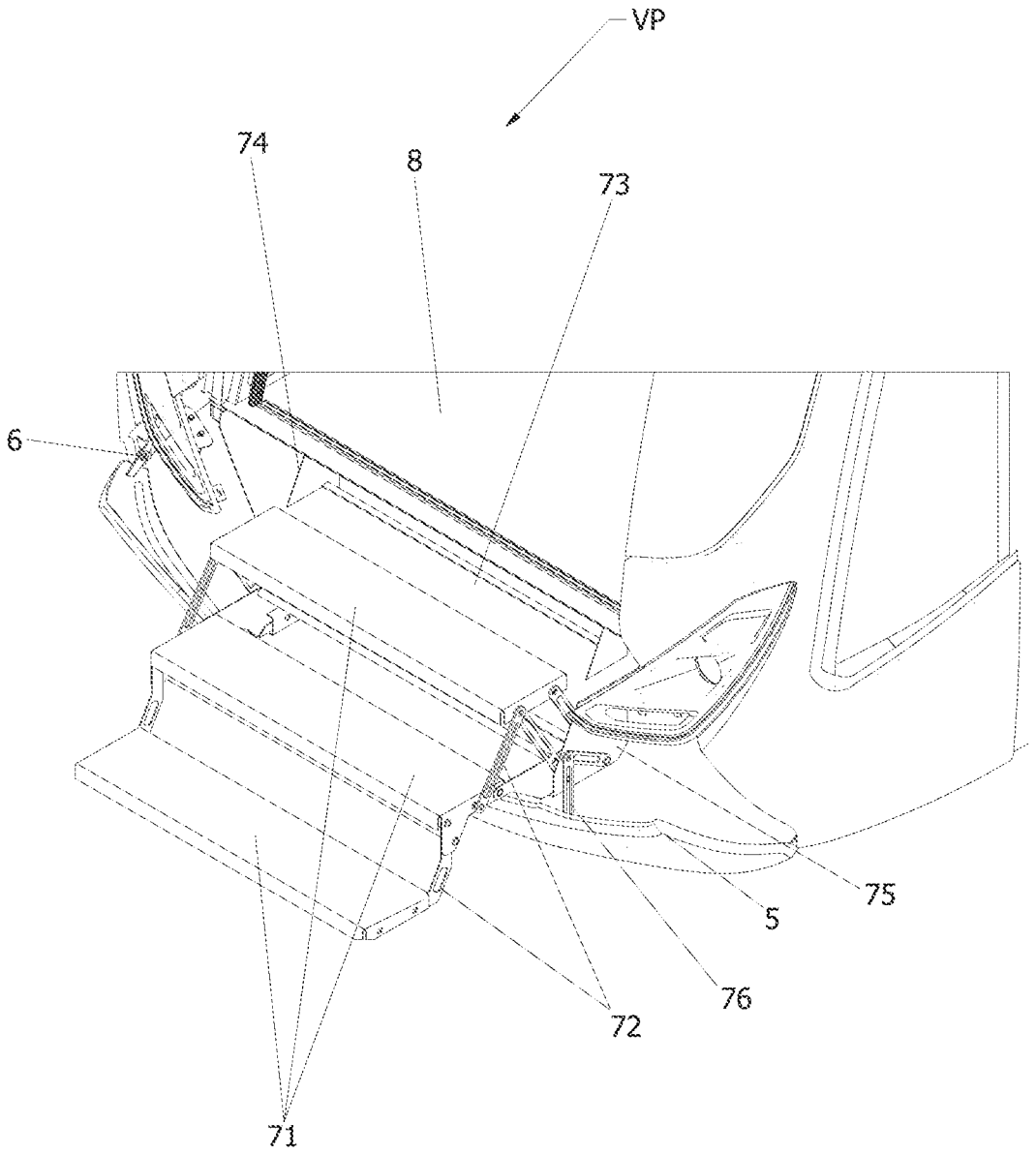

FIG. 5—Side view of the front of the vehicle with the front door open;

FIG. 6—Rear view of the front door;

FIG. 7—Front view of the front door;

FIG. 8—Perspective view from inside the door structure with details of the door lock actuation mechanism;

FIG. 9—Perspective view from inside the door frame, with details of the opening mechanism of the lower portion of the door;

FIG. 10—Perspective view from inside the door frame, with details of the opening mechanism connected to the upper portion of the door;

FIG. 11—Perspective view with details of the retractable stairs.

DETAILED DESCRIPTION OF THE INVENTION

The passenger or cargo vehicle (VP) moves along an elevated guideway (VE) that may have segments fitted with guardrails (GC) along the sides, fitted with emergency lights that are suitable for protecting and guiding users leaving the vehicle during an adverse event requiring them to exit the vehicle in an area outside the station. An elevated guideway (VE) is generally supported on columns (CL). The vehicle (VP) is equipped with wheeled bogies (RD) that roll along tracks (TR) supported by the elevated guideway (VE).

As described in detail in FIGS. 2 to 5, the front door (1) tilts in the structure of the vehicle (VP) on upper hinges (2), assisted by dampers (3), connected to an internal structure (4) of the front door (1) and the structure of the vehicle. The front door (1) is fitted with the lower portion (5) that tilts on the lower hinge (6) on the bodywork structure of the vehicle (VP).

The lower portion of the door (5) automatically projects outward when the front door (1) is opened by the action of cables and pulleys, as described below. When the lower portion of the door (5) is opened, the retractable staircase (7) is extended. When the retractable staircase (7) is retracted, it tucks under the floor of the vehicle (8).

The front door (1) is based on the modular concept, and is thus preferably rectilinear, whereby it is prepared to receive a glass front finish with any desired curvature. The front door (1) tilts upwards, being held in the horizontal position by dampers (3), leaving sufficient room for passengers to move through it quickly. The front door (1) has large translucent areas that extend to floor level (8), leaving the visibility area unencumbered when the vehicle (VP) is moving.

As shown in FIGS. 6 to 8, the preferably front-facing door (1) is activated internally by passengers using a lever (9) that turns the rod (10) that axially moves the shafts (11) that release the door locking mechanism (12). For safety reasons, this internal release depends on an electromagnetic safety key, allowing the front door (1) to be opened, should the vehicle break down. The front door (1) also has an outside handle (13) that tightens a cable (14) that also trips the locking mechanism (12), allowing it to be opened from outside the vehicle, for maintenance purposes, for example.

FIGS. 9 and 10 present the details of a preferred construction of the pulleys and cables system that controls the opening of the lower portion of the door (5) through articulating the hinge (6) fixed to the structure of the vehicle (VP), when the upper portion of the front door (1) is opened. A cable (15) is affixed to the front door (1) and through pulleys (16) reaches a lever that is part of the hinge (6), which allows the movement of the lower portion of the door (5).

FIG. 11, together with FIG. 10, presents the details of a preferred construction of the retractable staircase (7), that is positioned below the floor level (8) of the vehicle (VP), being comprised of retractable steps (71) held together by articulated bars (67), remaining retracted and folded into the lower compartment (73) when the front door (1) is shut. The articulated bars (72) are installed coaxially on the outer sides of the steps (71). Side panels (74) guide the retraction of the stairs. When the front door (1) is raised, the lower portion of the door (5) is articulated, whereby the articulated bars (76) pull on the side arms (75) and cause the gyration of the staircase (67), which automatically extends out onto the lower part of the guideway, providing safe access for passengers.

For safety reasons, the front door (1) locking system is fitted with an automatic control system that prevents its release when the vehicle is moving, through the locking action of an electromagnetic safety key. To do so, the electromagnetic key receives speed and movement information from the logic circuit of the vehicle. When moving (speed greater than 0), the electromagnetic key holds a pin in place that locks the door, so it cannot be opened. When the vehicle is halted (speed equal to 0), the electromagnetic key keeps the pin withdrawn, allowing the door to be opened by the internal lever.

The invention claimed is:

1. An emergency front door for pneumatic propulsion on an elevated guideway comprising: a vehicle that moves along an elevated guideway that has segments with side guardrails fitted with emergency lights that are suitable for protecting and guiding users leaving the vehicle in an area outside a station, wherein the front door articulated in the structure of the vehicle on upper hinges assisted by dampers connected to an internal structure of the front door, and the structure of the frame of the vehicle, wherein the front door has a lower portion that moves on a lower hinge on the structure of the frame of the vehicle wherein it is automatically projected outwards by the action of pulleys and cables, with a retractable staircase that extends outwards when opening the lower portion of the door and, when retracted, is folded below the floor of the vehicle, and wherein the front door is activated internally using a lever that turns a that axially moves one or more shafts that release a door locking mechanism), wherein the retractable staircase that is positioned below the floor level of the vehicle (VP) when retracted, being comprised of retractable steps held together by articulated bars, remaining retracted and folded into the lower compartment when the front door is closed, with the articulated bars installed coaxially on the outer sides of the steps, having side panels that guide the retraction of the stairs, whereby when the front door is raised, the lower portion of the door is articulated, whereby the articulated bars pull on the side arms and cause the steps of the stairs to turn and automatically project outwards and downwards.

2. The door of claim 1, wherein the front door has an outside handle that tightens a cable that also trips the locking mechanism.

3. The door of claim 1, wherein lower portion of the door is opened by a cable that is affixed to the front door and through pulleys reaches the lever that forms part of the hinge that moves the lower portion of the door.

4. The door of claim 1, wherein a front door locking system is fitted with an automatic control system that prevents its release when the vehicle is moving, through the locking action of an electromagnetic safety key that receives information from a logic circuit of the vehicle on its speed and movement.

* * * * *